US006802294B2

(12) United States Patent
Osman

(10) Patent No.: US 6,802,294 B2
(45) Date of Patent: Oct. 12, 2004

(54) OIL FILTER ADAPTOR FLANGE

(75) Inventor: Azmi B. Osman, Johor (MY)

(73) Assignee: Petroliam Nasional Berhad, Kuala Lumpur (MY)

( * ) Notice: Subject to any disclaimer, the term of this patent is extended or adjusted under 35 U.S.C. 154(b) by 0 days.

(21) Appl. No.: 10/028,743

(22) Filed: Dec. 20, 2001

(65) Prior Publication Data

US 2002/0100722 A1 Aug. 1, 2002

(30) Foreign Application Priority Data

Dec. 21, 2000 (MY) ..... PI 2000 6078

(51) Int. Cl.[7] ..... F01M 1/00
(52) U.S. Cl. ..... 123/196 R; 210/168; 210/249
(58) Field of Search ..... 123/196 R; 210/168, 210/249

(56) References Cited

U.S. PATENT DOCUMENTS 2,110,124 A * 3/1938 Gerald ..... 210/168
3,066,803 A 12/1962 Seils, Jr. ..... 210/168
3,067,880 A * 12/1962 Blowers et al. ..... 210/249
3,223,197 A * 12/1965 Conover et al. ..... 184/6.28
5,006,237 A 4/1991 Jones ..... 210/168
5,291,863 A 3/1994 Jones ..... 123/196 R

FOREIGN PATENT DOCUMENTS

DE 4012585 A1 10/1991
EP 0269 054 A 6/1988

* cited by examiner

*Primary Examiner*—Noah P. Kamen
(74) *Attorney, Agent, or Firm*—Dickinson Wright PLLC

(57) ABSTRACT

A flange for an oil filter adaptor, the flange having a peripheral sealing portion adapted to be contacted by and seal with a correspondingly sized and shaped mounting flange of the oil filter adaptor; the peripheral sealing portion defining at least one inlet opening and at least one outlet opening with there being at least one divider between the at least one inlet opening and the at least one outlet opening, the at least one divider extending between a first section of the peripheral sealing portion and a second section of the peripheral sealing portion, the first section being remote from the second section. An adaptor for use with the flange is also disclosed.

18 Claims, 3 Drawing Sheets

OIL FILTER ADAPTOR FLANGE

CROSS-REFERENCE TO RELATED APPLICATION

This application is based upon and claims priority to Malaysian Patent Application No. PI 2000 6078, filed Dec. 21, 2000, which application is hereby expressly incorporated by reference.

FIELD OF THE INVENTION

This invention relates to an oil filter adaptor flange and particularly, though not exclusively, to an oil filter adaptor flange to enable the correct positioning and attachment of an oil filter of an internal combustion or diesel engine. The present invention also relates to an adaptor, preferably for use with the flange.

BACKGROUND OF THE INVENTION

With modern automotive design significant emphasis is given to the coefficient of distortion, which determines the efficiency with which the automobile progresses through the air. In consequence, the size of the engine compartment of automobiles is being reduced. This is happening at the same time that extra space is required for anti-pollution equipment, fuel injection, cross-flow heads, overhead camshafts, and so forth.

The oil filter of an engine is known to occupy a significant space within the engine compartment. This explains why the oil filter is placed in many different locations, and orientations. The oil filter can be mounted on the cylinder block or ladderframe vertically (either upwardly or downwardly) or horizontally either at the front or back, and can be mounted oriented forwardly, rearwardly or sideways, depending on the available space. Furthermore, it is common for one engine series to be fitted in different vehicles. As a result, engine designers chose to use oil filter adaptors rather than a fixed oil filter housing. This ensures that the high cost of modifying the cylinder block or ladderframe mold to suit different vehicles can be avoided.

With oil filter adaptors, either extending or shortening the adaptor can avoid obstacles like vehicle drive shafts or exhaust pipes. Even with conventional oil filter adaptors, the choice of location of the oil filter is still limited. This is because the flange at the ladderframe or cylinder block where the oil filter adaptor will be attached enables only either upwards and downwards, or forwards and rearwards, directions. It is difficult for one flange to be used with four different orientations without changing the cylinder block or ladderframe.

It is therefore the principal object of the present invention to provide an oil filter adaptor flange capable of being combined with the oil filter adaptor for multi-orientation mounting.

A further object of the present invention is to provide an oil filter adaptor flange which enables the engine to be used in many different vehicles, including those with north-south, west-east, and east-west engine orientations. Yet another object of the present invention is to provide an oil filter adapter flange which allows flexibility in the orientation of the filter to enable vehicle designers to provide for ease of access by motorists and mechanics performing servicing of the engine.

SUMMARY OF THE INVENTION

With the above and other objects in mind, the present invention provides a flange for an oil filter adaptor, the flange having a peripheral sealing portion adapted to be contacted by and seal with a correspondingly sized and shaped mounting flange of the oil filter adaptor; the peripheral sealing portion defining at least one inlet opening and at least one outlet opening with at least one divider between the at least one inlet opening and the at least one outlet opening, the at least one divider extending between a first section of the peripheral sealing portion and a second section of the peripheral sealing portion, the first section being remote from the second section.

Preferably, the peripheral sealing portion is substantially rectangular in shape, the first section being a first corner of the rectangle, the second section being a second corner of the rectangle, the first corner being diagonally opposite the second corner. More preferably, the at least one inlet opening is substantially triangular, as is the at least one outlet opening. The at least one inlet opening may be the same size and shape as the at least one outlet opening.

There is preferably one inlet opening, and one outlet opening.

The at least one divider has an outer surface which may be co-planar with a mating surface of the peripheral sealing portion, and there may be one divider.

The present invention also relates to an engine block including such a flange.

In another form, the present invention provides an adaptor for an oil filter having an oil filter receiving portion, a body, and a mounting flange; the mounting flange having a first opening therethrough in operative communication with a first passage through the body and the oil filter receiving portion, and a second opening therethrough in operative communication with a second passage through the body and the oil filter receiving portion; the first opening and the second opening being separated by a divider, and the first passage and the second passage being separated by a barrier, the divider and the barrier being operatively connected.

Advantageously, the mounting flange is substantially rectangular and has a first corner and a second corner diagonally opposite the first corner, the divider extending between the first corner and the second corner. In consequence, the first opening may be substantially triangular, as may be the second opening. The first and second openings may be of different shapes and/or sizes.

Preferably, the divider has an outer surface which is co-planar with a mounting surface of the mounting flange.

DESCRIPTION OF THE DRAWINGS

In order that the invention may be better understood and readily be put into practical effect, there shall now be described by way of non-limitative example only preferred embodiments of the present invention, the description being with reference to the accompanying illustrative drawings in which.

DESCRIPTION OF PREFERRED EMBODIMENTS

Figure 1:
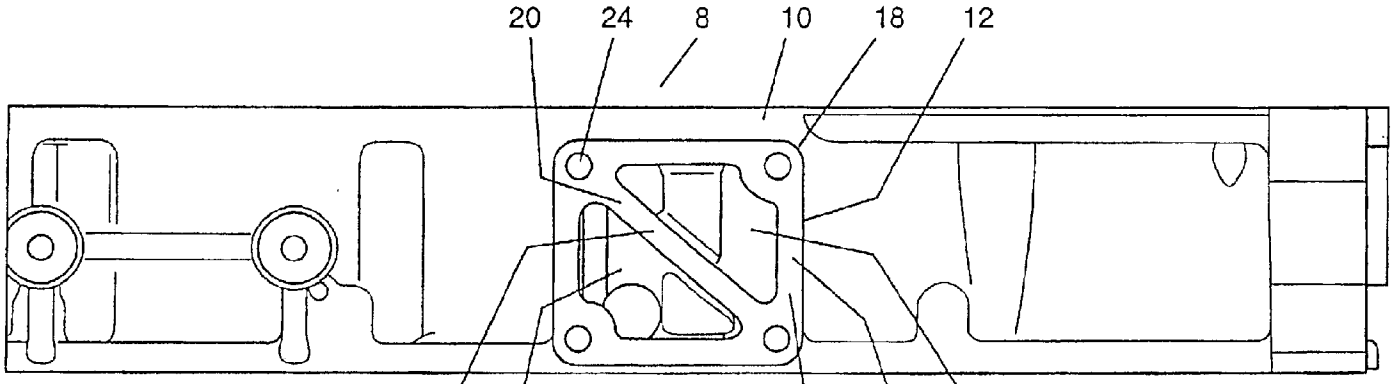
FIG. 1 is a plan view showing the flange of the present invention.

As is shown in FIG. 1 there is a ladderframe of a cylinder block 8 having a flange 10 with a peripheral sealing portion 12 which, as shown, is substantially rectangular. It has a mating surface 14 which is adapted to sealingly receive an oil filter adaptor 16 such as that shown in FIGS. 2 to 6. The flange 10 has four corners 18 with there being a diagonal divider 20 extending between two diagonally opposite corners. The divider 20 has an outer surface 22 which is coplanar with mating surface 14. Bolt holes 24 are provided in the normal manner. The divider 20 divides flange opening 26 into a first opening 28 and a second opening 30. Openings 28, 30 are both substantially triangular and are of identical size and shape, and thus area. With such an arrangement, the openings 28, 30 will provide inflow and outflow which is sufficient for each orientation of the adaptor 16, and thus the oil filter (not shown).

In FIG. 1, the left side of the ladderframe is the front, whereas the right side is the rear side of the ladderframe.

The second opening 30 is connected to the long passage extending from the front side whereas the first opening 28 is connected to an upward passage which is connected to the cylinder block 8.

The flange 10 is to provide enough support for the combined weight of oil filter adaptor 16, oil cooler (not shown) and the oil filter (not shown) during engine operation. The openings 28, 30 enable a long die to be used to provide channels for the oil flow. Moreover, uniform wall thickness can be maintained and bulky material concentration can be avoided.

As the flange 10 has its openings 28, 30 shaped and sized identically but with a diagonal divider 20, the oil filter adaptor 16 can be designed to have its inlet and outlet positioned to be over the openings 28, 30. Up to four different oil filter adaptors can be designed corresponding to upward, downward, backward and frontward.

The conventional oil filter adaptor has its inlet and outlet oil channels drilled. This machining operation can be expensive because the channels are long and cannot be drilled in a single operation (in those cases where the distance between the two drills is less than 30 mm).

With some modification to the overall shape, it is possible to avoid those two drilling operations. In order to eliminate the drilling operations, the opening areas of the inlet and outlet must be big enough to enable two dies to be used to provide the inlet and outlet channels.

Figure 3:
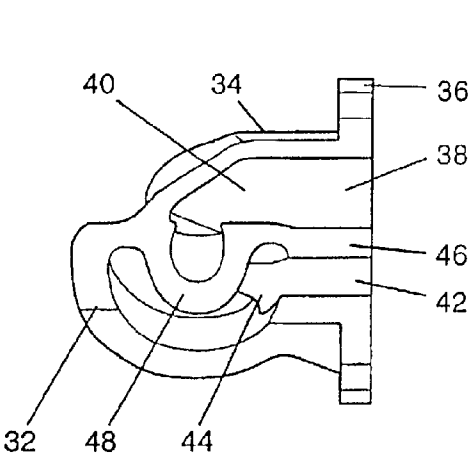
FIG. 3 is a cross-sectional view along the lines and in the direction of arrows 3—3 on FIG. 2.
Figure 4:
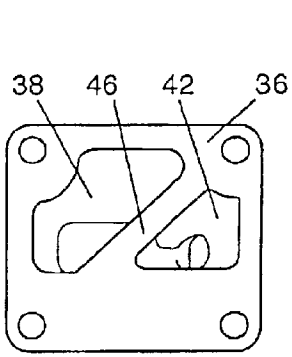
FIG. 4 is a rear view of the adaptor of FIG. 2.
Figure 2:
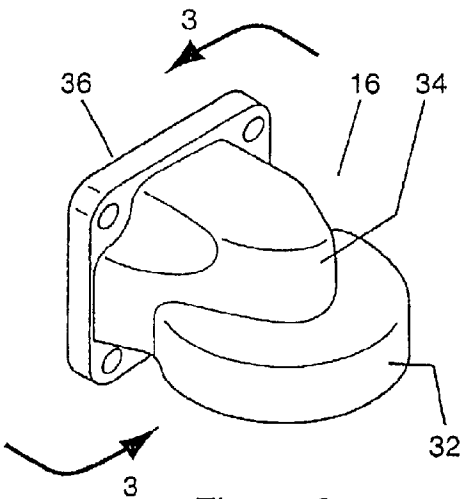
FIG. 2 is a perspective view of an oil filter adaptor with the mating face downwardly.

FIGS. 2 to 4 show the oil filter adaptor 16 with its oil filter receiving portion 32 facing downwardly. The flange 10 will provide enough support for the combined weight of the oil filter adaptor 16, oil cooler (not shown) and the oil filter (not shown) during engine operation. The adaptor 16 also has a body 34 and a mounting flange 36. The flange 36 has a first opening 38 operatively connected to a first passage 40 passing through body 34 and oil filter receiving portion 32; as well as a second opening 42 operatively connected to a second passage 44 passing through body 34 and oil filter receiving portion 32. A divider 46 separates the openings 38, 42; and a barrier 48 separates the passages 40, 44. The divider 46 and barrier 48 are operatively connected.

The openings 38, 42 are both generally triangular but are of different sizes. Neither is larger than the openings 28, 30, although it is preferred that opening 38 is generally the same size and shape as openings 28, 30. In this way, in a first orientation, opening 38 completely overlies opening 28. As opening 42 is smaller than opening 30, there is still full oil flow therebetween, and no sealing difficulties.

If adaptor 16 is rotated 180°, opening 38 overlies opening 30; and opening 42 overlies opening 28. Again, full oil flow and no sealing difficulties as openings 28, 30 are substantially identical.

The relatively large openings 38, 42 also enable a long die to provide passages 40, 44. Moreover, uniform wall thickness can be maintained and bulky material concentration can be avoided.

Figure 5:
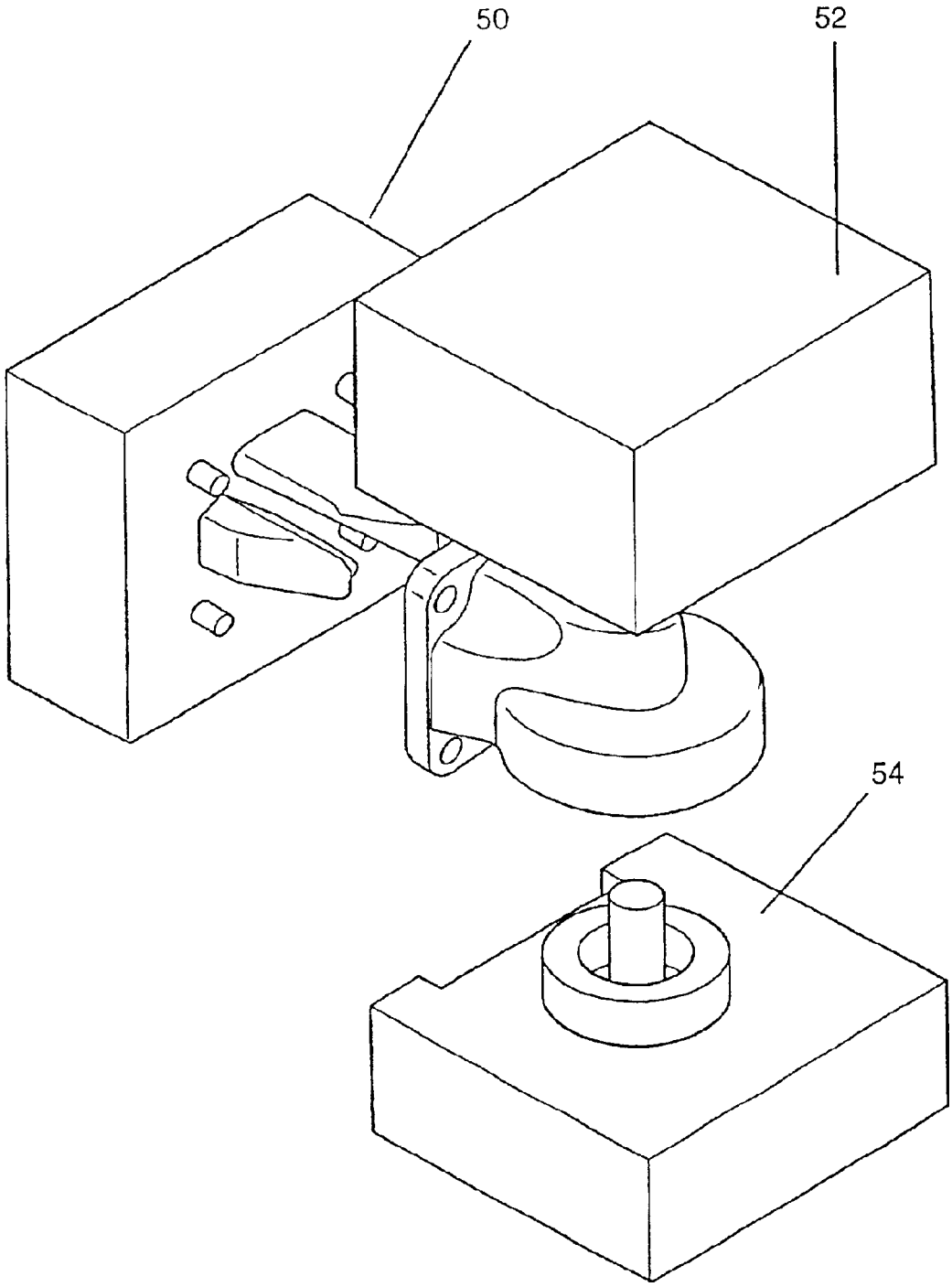
FIG. 5 is an exploded perspective view showing the manufacturing of the adaptor of FIG. 2 to 4.
Figure 6:
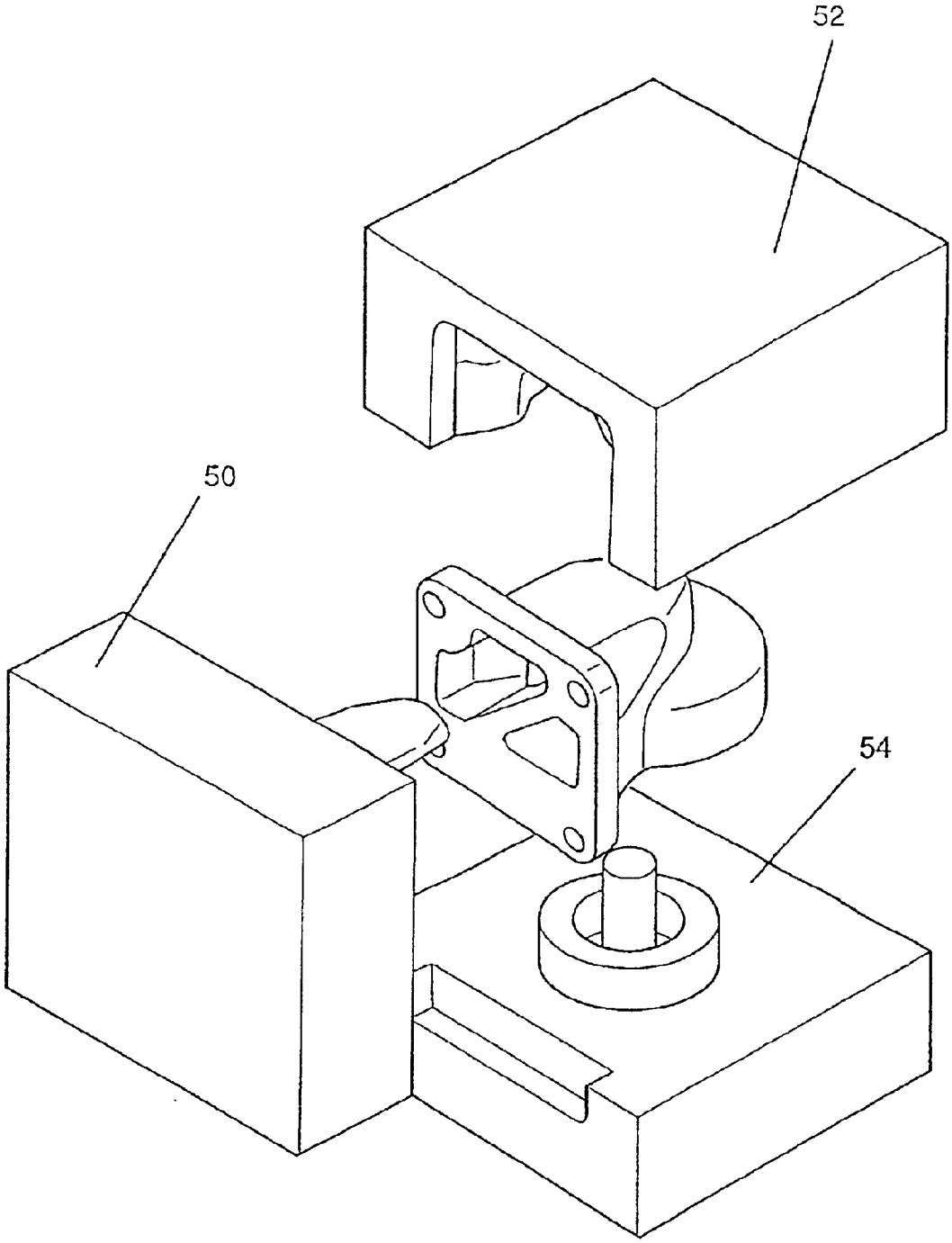
FIG. 6 is a rear view of FIG. 5.

From FIGS. 5 and 6, die 50 provides protrusions to shape the inlet, outlet and bolt holes; die 52 shapes the top of the adaptor; and die 54 provides protrusions to shape a round shape for the inlet passage for the oil to enter the filter. A small portion of the die 54 will almost contact die 50 in order to create the smaller opening 42 for oil to flow in.

The flange 10 can be used on a ladderframe, bedplate on cylinder block.

Whilst there has been described in the foregoing description preferred embodiments of the present invention, it will be understood by those skilled in the technology that many variations in details of design or construction may be made without departing from the present invention.

What is claimed is:

1. A flange for an oil filter adaptor, the flange comprising:

a peripheral sealing portion adapted to be contacted by and seal with a correspondingly sized and shaped mounting flange of the oil filter adaptor, the peripheral sealing portion defining at least one inlet opening and at least one outlet opening, there being at least one divider between the at least one inlet opening and the at least one outlet opening, the at least one divider extending between a first section of the peripheral sealing portion and a second section of the peripheral sealing portion, the first section being remote from the second section, wherein the peripheral sealing portion is substantially rectangular in shape, the first section being a first corner of the rectangle, the second section being a second corner of the rectangle, the first corner being diagonally opposite the second corner.

2. The flange of claim 1, wherein the at least one inlet opening is substantially triangular.

3. The flange of claim 1, wherein the at least one-outlet openingis substantially triangular.

4. The flange of claim 1, wherein the at least one inlet is the annie size, shape and area as the at least one outlet opening.

5. The flange of claim 1, wherein there is one inlet opening.

6. The flange of claim 1, wherein there is one outlet opening.

7. The flange of claim 1, wherein the at least one divider has an outer surface which is co-planar with a mating surface of the peripheral sealing portion.

8. The flange of claim 7, wherein there is one divider.

9. The flange of claim 1, being coupled to an engine component selected from the list consisting of an engine block, a ladderframe, and a bedplate.

10. The flange of claim 1, wherein the at least one divider has an outer surface which is co-planar with a mating surface of the peripheral sealing portion.

11. An adaptor for an oil filter having an oil filter receiving portion, a body, and a mounting flange, the mounting flange having a first opening therethrough in operative communication with a first passage through the body and the oil filter receiving portion, and a second opening therethrough in operative communication with a second passage through the body and the oil filter receiving portion; the first opening and the second opening being separated by a divider, and the first passage and the second passage being separated by a barrier, the divider and the barrier being operatively connected, wherein the mounting flange is substantially rectangular and has a first corner and a second corner diagonally opposite the first corner, the divider extending between the first corner and the second corner.

12. The adaptor of claim 11, wherein the first opening is substantially triangular.

13. The adaptor of claim 11, wherein the second opening is substantially triangular.

14. The adaptor of claim 11, wherein the first opening and the second opening are of different sizes.

15. The adaptor of claim 14, wherein the divider has an outer surface which is co-planar with a mounting surface of the mounting flange.

16. The adaptor of claim 11, wherein the divider has an outer surface which is co-planar with a mounting surface of the mounting flange.

17. An engine assembly comprising:

an engine component including one of an engine block, a ladder frame, and a bedplate;

a flange sealingly coupled to the engine component and including a peripheral sealing portion adapted to be contacted by and seal with a correspondingly sized and shaped mounting flange of the oil filter adaptor, the peripheral sealing portion defining at least one inlet opening and at least one outlet opening, there being at least one divider between the at least one inlet opening and the at least one outlet opening, the at least one divider extending between a first section of the peripheral sealing portion and a second section of the peripheral sealing portion, the first section being remote from the second section; and an oil filter adaptor sealingly coupled to the flange and including an oil filter receiving portion, a body, and a mounting flange, the mounting flange having a first opening therethrough in operative communication with a first passage through the body and the oil filter receiving portion, and a second opening thcrethrough in operative communication with a second passage through the body and the oil filter receiving portion, and the first opening and the second opening being separated by a divider, and the first passage and the second passage being separated by a barrier, the divider and the barrier being operatively connected, and wherein the oil filter adaptor is operably positionable in first and second orientations relative to the flange, wherein the first opening overlics the inlet opening in the flange when the adaptor is in said first orientation, and wherein the first opening overlies the outlet opening in the flange when the adaptor is in said second orientation.

18. The engine assembly of claim 17, wherein the first and second openings of the oil filter adaptor are no larger than the inlet and outlet openings of the flange.

* * * * *

UNITED STATES PATENT AND TRADEMARK OFFICE

CERTIFICATE OF CORRECTION

PATENT NO. : 6,802,294 B2
DATED : October 12, 2004
INVENTOR(S) : Azmi B. Osman

It is certified that error appears in the above-identified patent and that said Letters Patent is hereby corrected as shown below:

Column 4,
Line 38, “openingis” should be -- opening is --.
Line 40, “annie” should be -- same --.

Column 6,
Line 8, “thcrethrough” should be -- therethrough --.
Line 18, “overlics” should be -- overlies --.

Signed and Sealed this

Eighth Day of February, 2005

JON W. DUDAS
*Director of the United States Patent and Trademark Office*